US005091751A

United States Patent [19]

Inoue et al.

[11] Patent Number: 5,091,751

[45] Date of Patent: Feb. 25, 1992

[54] IMAGE FORMING APPARATUS UTILIZING INTERMEDIATE TRANSFER MEMBER

[75] Inventors: Masahiro Inoue, Kawasaki; Koji Amemiya, Tokyo; Akio Ohno; Takeo Tsunemi, both of Yokohama, all of Japan

[73] Assignee: Canon Kabushiki Kaisha, Tokyo, Japan

[21] Appl. No.: 530,802

[22] Filed: May 30, 1990

[30] Foreign Application Priority Data

| | | | |
|---|---|---|---|
| May 31, 1989 | [JP] | Japan | 1-138778 |
| May 31, 1989 | [JP] | Japan | 1-138780 |
| May 31, 1989 | [JP] | Japan | 1-138964 |
| May 28, 1990 | [JP] | Japan | 2-139035 |

[51] Int. Cl.[5] ..... G03G 15/00; G03G 15/01; G03G 15/16

[52] U.S. Cl. ..... 355/274; 355/309; 355/326

[58] Field of Search ..... 355/271, 272, 274, 275, 355/277, 326, 327

[56] References Cited

U.S. PATENT DOCUMENTS

| | | | |
|---|---|---|---|
| 3,850,519 | 11/1974 | Weikel, Jr. | 355/309 |
| 4,101,212 | 7/1978 | Sumiyoshi et al. | 355/274 |
| 4,110,027 | 8/1978 | Sato et al. | 355/3 TR |
| 4,114,536 | 9/1978 | Kaneko et al. | 101/426 |
| 4,851,960 | 7/1989 | Nakamura et al. | 361/225 |

FOREIGN PATENT DOCUMENTS

| | | |
|---|---|---|
| 0298505 | 1/1989 | European Pat. Off. . |
| 2359331 | 7/1974 | Fed. Rep. of Germany . |
| 2558615 | 7/1976 | Fed. Rep. of Germany . |
| 2702110 | 7/1977 | Fed. Rep. of Germany . |
| 59-119373 | 7/1984 | Japan . |

*Primary Examiner*—Joan H. Pendegrass
*Attorney, Agent, or Firm*—Fitzpatrick, Cella, Harper & Scinto

[57] ABSTRACT

An image forming apparatus having a photosensitive drum and a transfer drum including a transfer member carrying sheet substantially contacting the photosensitive drum. In order to enable a toner image formed on the photosensitive drum to be efficiently transferred to a transfer member, the apparatus has a pressing sheet for outwardly pressing the transfer member carrying sheet from the interior of the transfer drum and a conductive member provided on the side of the pressing sheet adjacent the transfer member carrying sheet. The conductive member serves to realize a uniform distribution of surface potential on the pressing sheet and to maintain the surface potential constant, so that the intensity of the electric field applied to the corona discharge is made constant at a low level so that a stable transfer corona is applied to the transfer member carrying sheet, thus ensuring good quality of the transferred image.

110 Claims, 15 Drawing Sheets

MEAN TONER PARTICLE SIZE 8μm

IMAGE FORMING APPARATUS UTILIZING INTERMEDIATE TRANSFER MEMBER

BACKGROUND OF THE INVENTION

1. Field of the Invention

The present invention relates to an image forming apparatus which forms an image by an electrophotographic process or an electrostatic recording process. More particularly, the present invention is concerned with an image forming apparatus having an image transfer device for transferring a toner image formed on an image carrier from the image carrier to a transfer member which is carried by a transfer member carrying means.

2. Description of the Related Art

FIG. 6 shows a known multi-color electrophotographic copying apparatus. This apparatus has a rotary-type developing device. More specifically, referring to FIG. 6, the multi-color electrophotographic copying apparatus has an image carrier, i.e., a photosensitive drum 3, rotatably supported and capable of rotating in the direction of the arrow, and image forming means arranged around the photosensitive drum 3. The image forming means may be of any type. In the illustrated apparatus, the image forming means includes a primary charger 11 for uniformly charging the surface of the photosensitive drum 3, an exposure device 12 such as, for example, a laser beam exposure unit capable of exposing the photosensitive drum 3 to color-separated light images or an equivalent images so as to form electrostatic latent images on the photosensitive drum 3, and a rotary developing device 13 for developing the latent images on the photosensitive drum to make the images visible.

The rotary developing device 13 includes four developer containers 2Y,2M,2C and 2BK which contains an yellow color developer, a magenta color developer, a cyan color developer and a black color developer, respectively, and developing units 1Y, 1M, 1C and 1Bk which are supplied with the respective developers from the developer containers. These four developing units are arranged for rotation about an axis of a substantially cylindrical casing. These rotary developing device 13 is arranged such that a rotation of the substantially cylindrical casing causes a desired developing unit to be moved to a position where it opposes the outer peripheral surface of the photosensitive drum 3 so as to develop an electrostatic latent image on the photosensitive drum 3. This operation is repeated to produce a full-color (four color) image on the photosensitive drum 3.

The developed visible image (referred to as "toner image" hereinafter) on the photosensitive drum 3 is transferred, at a transfer position, to a transfer member P which is carried by a transfer member carrier sheet 14 (see FIG. 7) which serves as transfer member carrying means. The term "transfer position" is used to mean a position where a transfer drum 4 opposes the photosensitive drum 3 across the transfer member P.

As shown in FIGS. 7 and 8, the transfer drum 4 has ring portions 4*a*, 4*b* disposed on both axial ends thereof and a bridge portion 4*c* interconnecting these ring portions 4*a*, 4*b*. A transfer member carrier means 14 is stretched over an open area formed between both ring portions 4*a*,4*b*. The transfer member carrier means 14 is typically a film-like dielectric sheet such as of polyethylene terephthalate, polyvinylidene fluoride or the like material. The bridge portion 4*c* has a transfer member gripper 15 for gripping a transfer member P which is fed from a sheet feeder. The transfer member gripper 15 for mechanically gripping the transfer member P may be substituted by an electrostatic absorption means (not shown) which can electrostatically attract and hold the transfer member P onto the transfer member carrier means 14.

A transfer charger 7 as a transfer means and a charge-removing discharger 10 are disposed inside the transfer drum 4, while charge removing dischargers 9 and 16 are arranged outside the transfer drum 4.

The process for forming a full-color image by the described multi-color electrophotographic copying apparatus will be outlined.

The surface of the photosensitive drum 3 is uniformly charged by a primary charger, and is irradiated with a light image corresponding to a picture information formed by the exposure device 12, whereby an electrostatic latent image is formed on the surface of the photosensitive drum 3. The latent image thus formed is developed by the rotary developing device 13 with a toner containing a resin as a base material and having a mean particle size of 12 μm so that a visible toner image is formed.

Meanwhile, the transfer member P is fed onto the transfer drum 4 by a register roller 17 in synchronization with the formation of the image and is caught at its leading end by the gripper 15 so as to be moved in the direction of the arrow bin accordance with the rotation of the transfer drum 4.

Subsequently, in the transfer position, a corona discharge of the opposite polarity to the toner is effected by the transfer charger 7 from the back side of the transfer member carrying means 14, i.e., the dielectric sheet 14, of the transfer drum 4, whereby the toner image is transferred from the photosensitive drum 3 to the transfer member P.

This operation is repeated a desired number of times and, thereafter, the transfer member P is separated from the transfer drum 4 by the action of a separator claw 18 while electrostatic charges are removed by the charge removing dischargers 9, 10 and 16. The separated transfer member P is then conveyed by a conveyor belt 19 to a fixing device 20 which applies heat to the toner image so as to fix the toner image to the transfer sheet. The transfer sheet is then ejected from the apparatus.

Meanwhile, the portion of the photosensitive drum 3 from which the toner image has been transferred is made to pass through a cleaning device 21 which removes any residual toner from the surface of the photosensitive drum 3, and is then subjected again to the image forming process. At the same time, the dielectric sheet 14 on the transfer drum 4 is cleaned by a cleaning device 22 having, for example, a fur brush, as well as an auxiliary cleaning means 23, so as to be used again in the image forming process.

In order to cope with a current demand for higher grade of image quality, it is desirable to attain a higher degree of fineness of the latent image and to improve the reproducibility of the latent image. To met these demands, it is a current measure to use, as the developer, toners of small particle sizes, e.g., 10 μm or smaller and about 8 μm or smaller in terms of mean size. In general, a smaller particle size increases the quantity of charges per unit mass, as well as Van der Waals force, due to increase in the specific area. As a result, the adhesion of the toner particles to the photosensitive drum is enhanced, with the result that a higher intensity of the transfer electric field or higher degree of closeness of contact between the transfer member and the photosensitive drum is required to obtain good transfer performance. Unfortunately, however, non-uniform or irregular transfer is caused due to local transfer failures caused by local minute gaps formed between the photosensitive drum and the transfer member in the transfer region.

In order to obtain a clear transferred image by improving the transfer efficiency, it has been proposed to use a pressing member, e.g.,an elastic sheet 1, which is disposed upstream of the transfer charger 7 as viewed in the direction of rotation of the transfer drum 4 so as to extend in the downstream direction from the inlet side of the transfer drum 4 and which is capable of pressing the dielectric sheet 14.

The provision of the elastic sheet 1 alone, however, poses the following problem. Namely, the corona discharge by the transfer corona discharger 7 is effected over the entire area of the elastic sheet 1 so that a large quantity of charges is accumulated on the elastic sheet 1 so that a strong electric field is generated to block the corona discharge which is directed from the discharger 7 towards the sheet 14, thus impeding the charging of the dielectric sheet 14 by the corona discharger 7. Furthermore, any slight unevenness of the charge distribution on the elastic sheet 1, attributable to a minor non-uniformity of the discharge, tends to grow large due to accumulation of the large quantity of charges. Such large unevenness of he charge distribution adversely affects the electric field, causing non-uniform charging of the dielectric sheet 14 and, hence, an irregular transfer of the image, resulting in an inferior quality of the transferred image.

A transfer device of the type which transfers and superposes a plurality of toner images as in the case of a multi-color image forming apparatus, particularly when a fine toner of a particle size of 10 μm or smaller is used, requires a higher intensity of the transfer electric field than in the case where a monochromatic image formation is conducted or a toner having greater particle sizes, e.g., 12 μm or greater, is used.

In consequence, the elastic sheet 1 is charged more strongly due to application of the stronger transfer electric field, with the result that the non-uniformity of the charging and, hence, irregularity in the image transfer are enhanced so as to seriously deteriorate the quality of the image.

Japanese Patent Unexamined publication No. 59-119373 disclosed various methods for obviating the above-described problems. For instance, it is proposed to use a conductor adhered to the side of the elastic sheet adjacent the corona charger and connected to a bias power supply. It is also proposed to ground the above-mentioned conductor through a constant-voltage element. In the arrangement in which the conductor is connected to a bias power supply, a bias of the same polarity as the corona charging is applied to the conductor so as to efficiently apply the corona discharge to the transfer member carrier sheet. When a constant-voltage element is used, the conductor is stably held at a constant potential so as to stabilize the effect of the corona discharge.

In these proposed methods, however, the conductor is undesirably influenced by the ozone and nitrogen oxides generated as a result of the corona discharge, because the conductor is adhered to the side of the pressing member which is directly subjected to the corona discharge. As a consequence, the electrical characteristics of the conductor is undesirably changed to impair the effect of provision of the conductor.

SUMMARY OF THE INVENTION

Accordingly, an object of the present invention is to provide an image forming apparatus which can form an image of good quality without suffering from any substantial transfer irregularity and any local transfer failure.

Another object of the invention is to provide an image forming apparatus which can operate for a long time without degrading the quality of the formed images.

Still another object of the present invention is to provide an image forming apparatus which can reduce both the level and degree of fluctuation of the surface potential of a pressing member.

To these ends, according to one aspect of the present invention, there is provided an image forming apparatus comprising: image carrying means; toner image forming means for forming a toner image on the image carrying means; transfer member conveying means for conveying a transfer member to an image transfer position and including transfer member carrying means for carrying the transfer member; image transfer means for causing the toner image to be transferred to the transfer member carried by the transfer member carrying means at the image transfer position; and pressing means disposed in the vicinity of the image transfer means and capable of pressing the transfer member carrying means towards the image carrying means, the pressing means including a pressing member and a conductive member provided on the side of the pressing member facing the transfer member carrying means which is pressed by the pressing member.

The above and other objects, features and advantages of the present invention will become clear from the following description of the preferred embodiments when the same is read in conjunct ion with the accompanying drawings.

DESCRIPTION OF THE PREFERRED EMBODIMENTS

Figure 6:
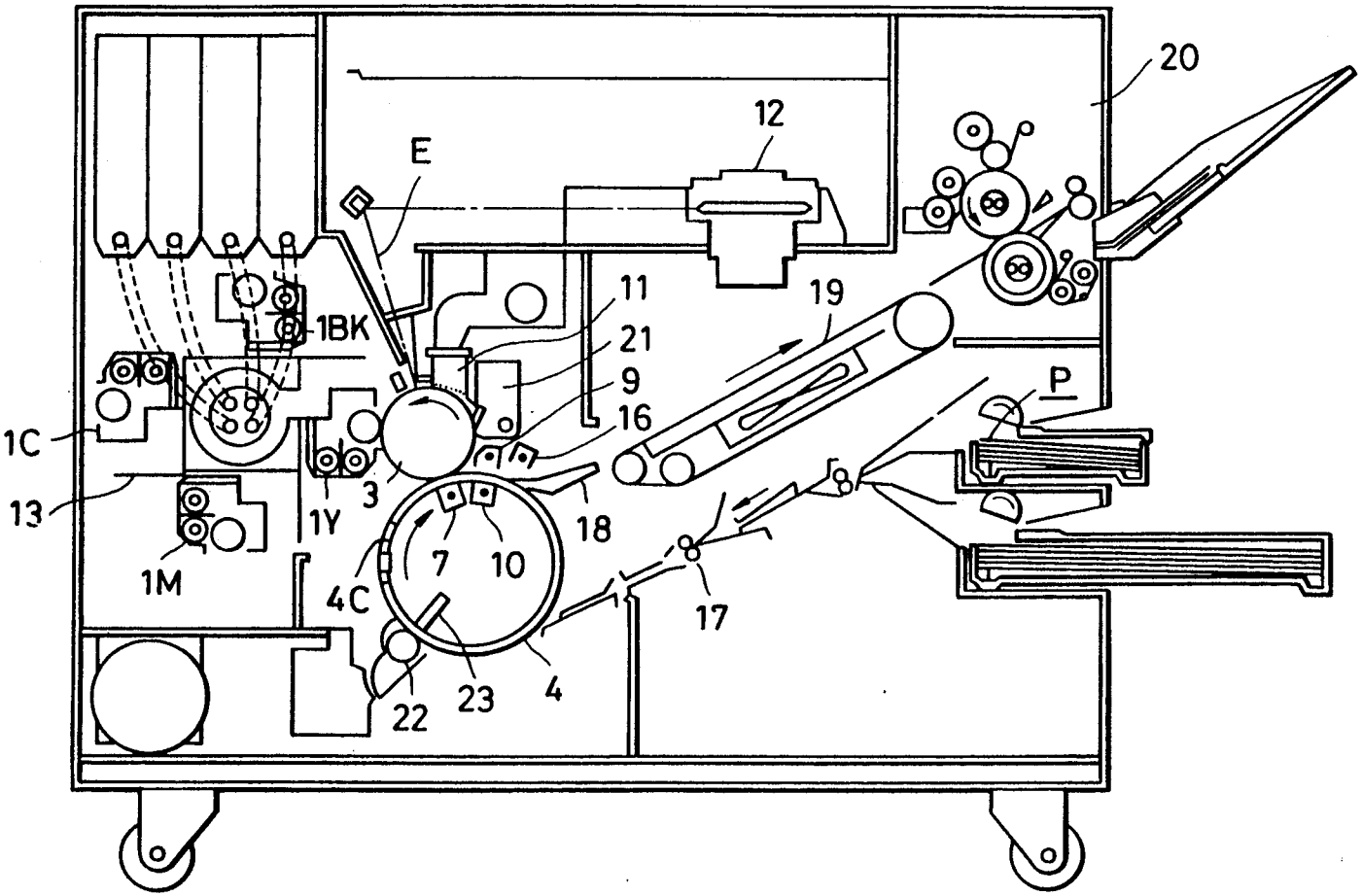
FIG. 6 is a schematic illustration of an image forming apparatus for performing a color process.
Figure 7:
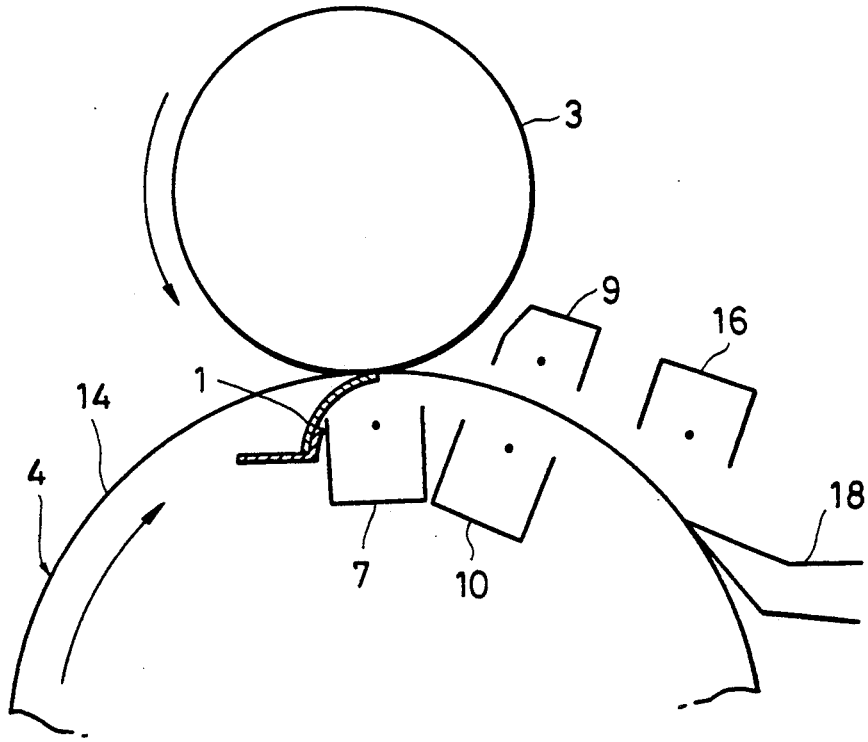
FIG. 7 is a schematic illustration of a conventional pressing means.

Preferred embodiments of the present invention will be described with reference to the drawings. The embodiments described hereinafter are intended for use in a multi-color electrophotographic copying apparatus described before in connection with FIG. 6. The following description of the embodiments, therefore, also will refer to FIG. 6. The apparatus shown in FIG. 6 is assumed to have a transfer device of the type described before in connection with FIG. 8. Description of the constructions and operations of the electrophotographic copying apparatus and the transfer device is therefore omitted to avoid duplication of explanation.

Figure 1:
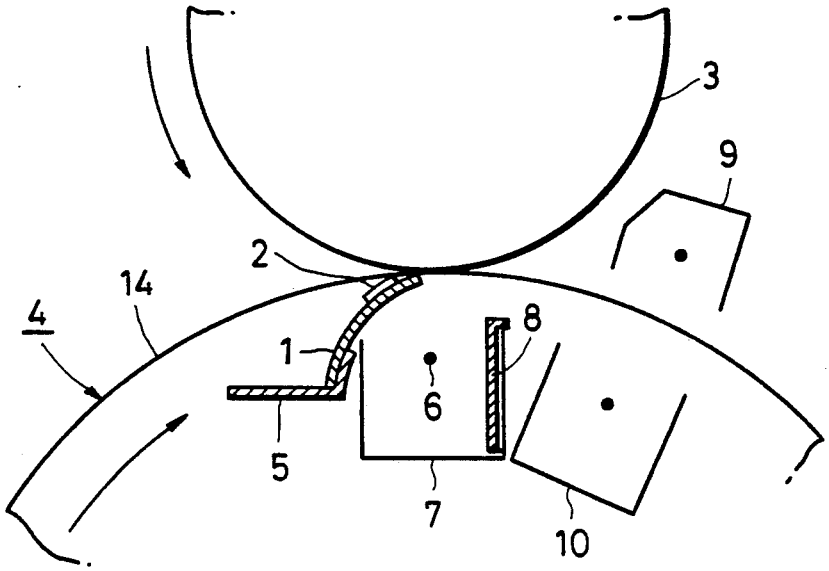
FIG. 1 is a schematic illustration of a first embodiment of the present invention.
Figure 8:
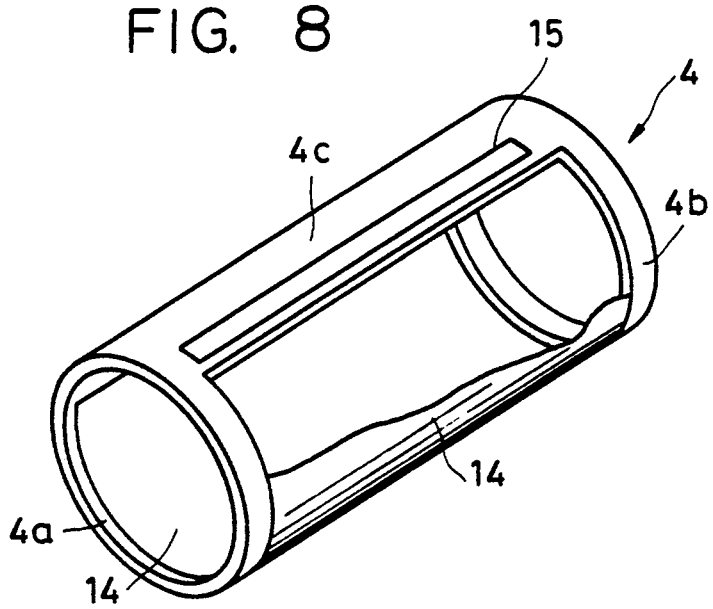
FIG. 8 is a schematic perspective view of a transfer drum.

FIG. 1 clearly shows a critical portion of the first embodiment of the present invention, i.e., a transfer device including the transfer drum 4 which is of the same type as that shown in FIG. 8 and which serves as a transfer member conveying means. As explained before, the transfer drum 4 has a pair of end rings 4*a* and 4*b* made of a conductive material such as a metal, and a dielectric sheet 14 serving as the transfer member carrying means stretched over the open area between both end rings 4*a*, 4*b*. The dielectric sheet 14 is made of a suitable dielectric material such as polyvinylidene fluoride (PVdF) and has a thickness ranging between 70 μm and 200 μm, a dielectric constant ranging between 3.0 and 13.0 and a volumetric resistivity ranging between $10^9$ and $10^{14}$ Ω·cm. The dielectric sheet 14 is fastened at its leading and trailing ends to the bridge portion 4*c* interconnecting two end rings 4*a* and 4*b* of the transfer drum 4.

In this embodiment, the transfer drum 4 has a diameter of 160 mm and is operated to rotate at a peripheral speed of 160 mm/sec. The process speed including the peripheral speed of the photosensitive drum 3 also is set to 160 mm/sec. The transfer corona discharger 7 has an opening of 19 mm wide through which discharge wires 6 are exposed. The distance between the ends of the discharge wires 6 and the outer peripheral surface of the photosensitive drum 3 as the image carrier is determined to be 10.5 mm, while the distance between the discharge wires 6 and the bottom surface of the shield plate of the transfer corona discharger 7 is set to 16 mm.

It is possible to provide an insulating member such as a plate of polycarbonate on the surface of the shield plate of the transfer corona discharger 7 facing the discharge electrodes or wires 6, in particular on the shield plate which is downstream of the transfer corona discharger as viewed in the direction of rotation of the transfer drum 4 which is indicated by the arrow. With such an arrangement, it is possible to obtain a greater concentration of the transfer corona towards the photosensitive drum 3.

A resilient pressing member 1 is provided in a transfer section which is determined by the width of discharge from the transfer corona discharge, so as to extend substantially in the downstream direction as viewed in the direction of movement of the surface of the transfer drum 4. The pressing member 1 is made of a dielectric plastic film such as of polyethylene, polypropylene, polyester or polyethylene terephthalate, preferably having a volumetric resistivity not smaller than $10^{10}$ Ω·cm and more preferably not smaller than $10^{14}$ Ω·cm. The pressing member is extended over the entire area of the transfer section. In this embodiment, a polyethylene terephthalate film is used as the pressing member 1.

The pressing member 18 is preferably arranged such that it can press the dielectric sheet 14 onto the photosensitive drum 3 by its resiliency. It is also preferred that the end of the pressing member 1 adjacent the dielectric sheet 14 is located at a transfer position, more specifically, the position at which the contact between the transfer member P and the photosensitive drum 3 is ceased, a position at which the transfer member P starts to contact with the photosensitive drum 3 or the position where the distance between the transfer member P and the photosensitive drum is minimized.

In order that the pressing member can apply a moderate pressing force to the dielectric sheet without substantially affecting the transfer electric field, the thickness of the pressing member is preferably selected to range between 10 μm and 2 mm. Excellent results were obtained with pressing members of thicknesses ranging between 75 μm and 200 μm.

If the role of the pressing member 1 is merely to press the dielectric sheet 14 of the transfer drum, it will be possible to provide the pressing member 1 at a position downstream from the transfer corona discharger as viewed in the direction of movement of the surface of the transfer drum 4. Such an arrangement, however, will undesirably allow the transfer to be commenced before the transfer member P is brought into close contact with the photosensitive drum 3, thus reducing the effect of preventing local transfer failures. It is therefore preferred that the pressing member be located at a position upstream from the transfer corona discharger 7 as viewed in the direction of movement of the surface of the transfer drum 4, as in the illustrated embodiment.

According to the present invention, a sub-conductive member 2 is provided on the pressing member 1 as shown in FIG. 1. The sub-conductive member 2 is preferably arranged to oppose the transfer member carrying means.

The sub-conductive member 2 is made of any suitable material which has a volumetric resistivity of $10^6$ Ω·cm to $10^{10}$ Ω·cm, preferably $10^7$ Ω·cm to $10^9$ Ω·cm. The sub-conductive member 2, therefore, mat be formed by dispersing a low-resistance substance on a high-resistance substance or may be formed of a single material having a volumetric resistivity falling within the range specified above.

The sub-conductive member 2 may be formed by applying a liquid-state material to the surface of the pressing member or by adhering a sheet-like member onto the pressing member 1. A video tape containing iron oxide powder can suitably be used as the sheet-type material of the sub-conductive member 2.

Figure 2:
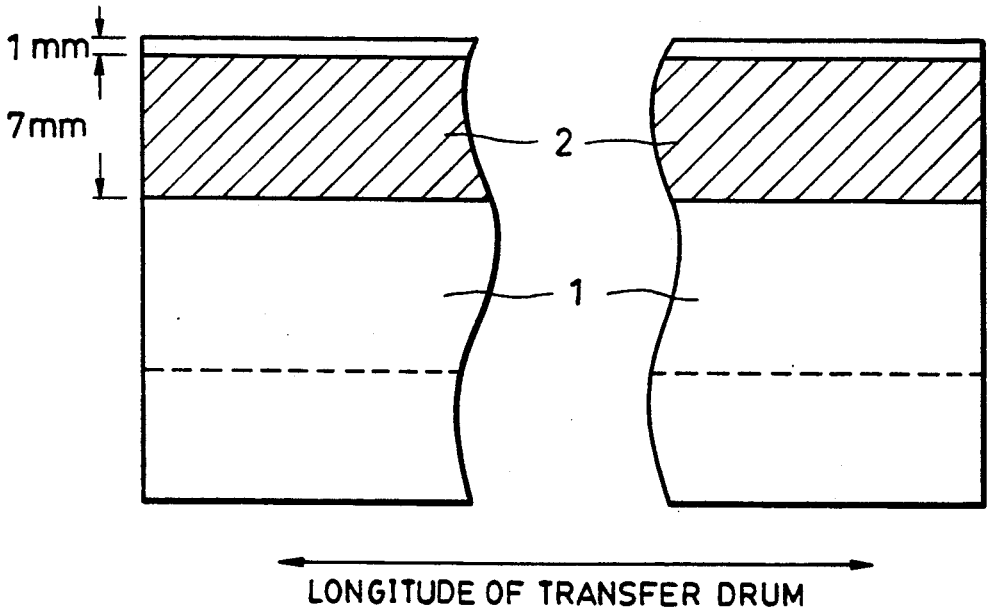
FIG. 2 is an enlarged view of a pressing means used in the first embodiment.

As will be seen also from FIG. 2, the sub-conductive member 2 is preferably formed in the region where the discharge for the image transfer actually takes place. In this embodiment, the sub-conductive member 2 is formed so as to extend over a width of 7 mm from a position which is 1 mm spaced from the end of the pressing member 1 contacting the dielectric sheet 14 of the transfer drum 4. The thickness of the sub-conductive portion is about 30 μm. It is not preferred to provide the sub-conductive member 12 in the vicinity of the extreme end of the pressing member 18 because in such a case the sub-conductive member 2 tends to be heavily damaged or worn as it is strongly rubbed by the dielectric sheet 14 and also by the bridge portion 4c of the transfer drum 4. Conversely, when the sub-conductive member 2 is positioned more than 5 mm apart from the extreme end of the pressing member 1, the advantage of the present invention is significantly impaired. It is therefore not preferred to dispose the sub-conductive member 2 at a position more than 5 mm apart from the extreme end of the pressing member 1.

Referring to FIG. 2, the pressing member 1 is fixed to its supporting member at a portion thereof below a broken line in this Figure. Thus, the pressing member 1 exerts resiliency at its portion above the broken line.

The present inventors have tested the image forming apparatus of this embodiment. Electrostatic latent images formed on the photosensitive drum 3 charged negatively were inversely developed to form a multi-color toner image with toners having mean toner particle sizes of about 12 μm. The toners used in the test was formed from a resin particle mixed with coloring agents and also with trace amounts of agents which were added for the purpose of improving charge-controllability and lubricating performance. The toners thus formed were negatively charged with carrier particles in the developing units. The multi-color toner image was transferred to a transfer member by the transfer device of the type described before. The transfer material was then separated from the transfer drum 4 and sent to a fixing device where the multi-color toner image was fixed to the transfer material.

Figure 3:
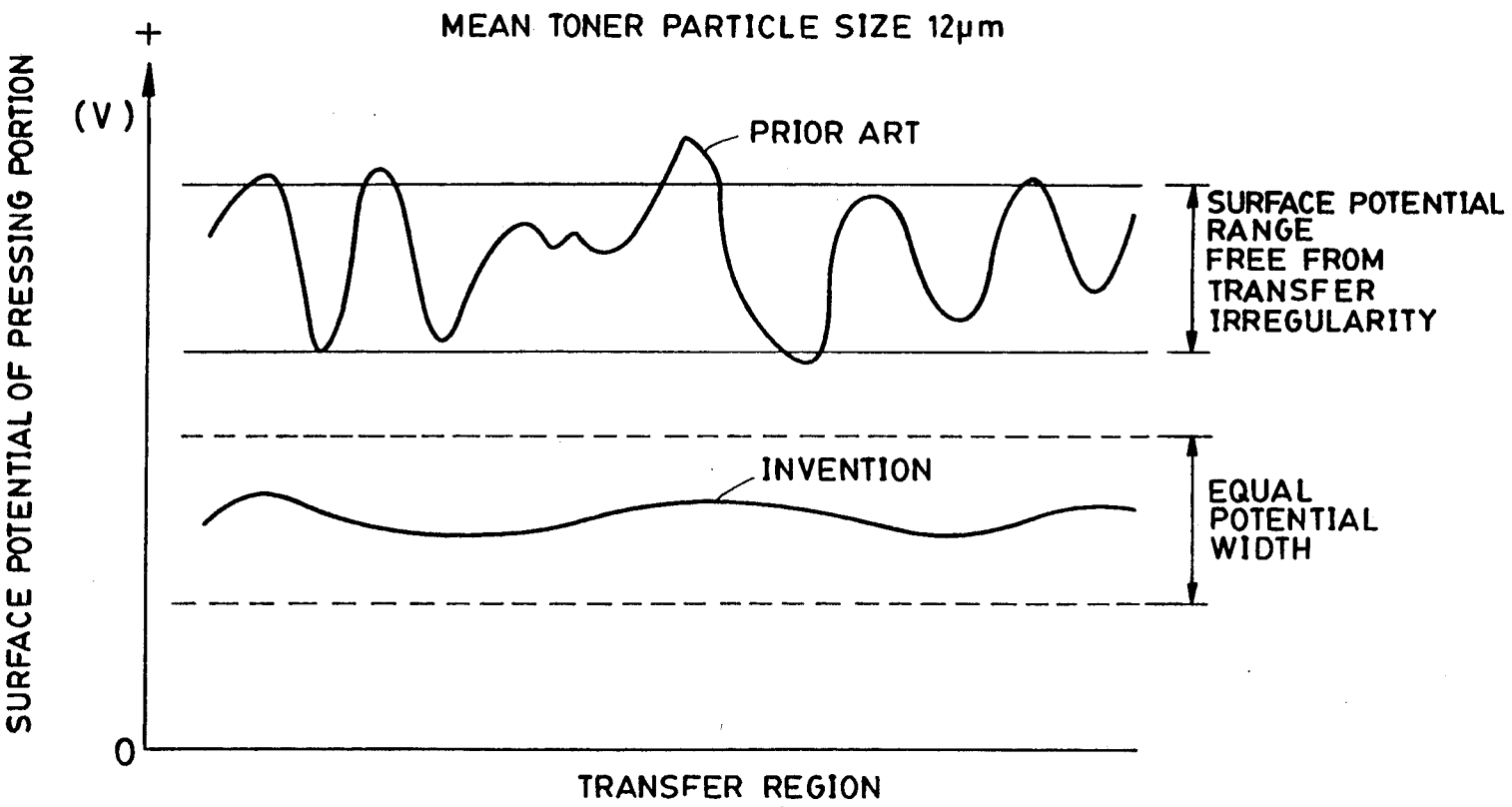
FIG. 3 is a chart showing the surface potential of a pressing portion as observed when a toner of a mean toner particle size of 12 μm is used.

The surface potential of the pressing member in the region adjacent the portion pressing the dielectric sheet was measured and compared with the surface potential as observed when a conventional pressing member devoid of the sub-conductive member was used. The results are shown in FIG. 3. From the Figure, it will be seen that both the level of the surface potential and the amplitude or magnitude of fluctuation of the surface potential are reduced when the pressing member 1 of the invention with the sub-conductive member 2 is used, as compared with the case where the conventional pressing member having no sub-conductive member is used.

The present inventors have conducted a further study on the mechanism of the image transfer and found that non-uniform transfer of image, i.e., is attributable to a large local fluctuation in the surface potential of the pressed. portion of the dielectric sheet. The relationship between the occurrence of transfer irregularity and the surface potential of the dielectric sheet was examined in the conventional case where the pressing member having no sub-conductive member was used. It was confirmed that image transfer can be conducted in good manner when the surface potential falls within the range which is defined by two horizontal parallel solid lines shown in FIG. 3. It was also found that the magnitude of fluctuation of the surface potential produces a more significant influence on the transfer irregularity than the absolute value of the surface potential.

Referring again to FIG. 3, two parallel broken lines define the range which is the same as the surface potential range shown by the two horizontal parallel solid lines mentioned above, i.e., the surface potential range which ensures good transfer if image with the conventional pressing member having no sub-conductive member. It will be seen that the surface potential observed when the pressing member having the sub-conductive member is maintained within this range, thus proving that image can be transferred in a good manner without irregularity. It was also confirmed that a reduction in the absolute value of the surface potential widens the range which is free from occurrence of transfer irregularity.

In the described embodiment, both the absolute value of the surface potential and the magnitude of the surface potential fluctuation are reduced. This is attributed to the following reasons.

In the described embodiment, the sub-conductive member 2 on the pressing member 1 has a volumetric resistivity of about $10^8$ Ω·cm, so that it promotes discharge of electrostatic charges from the pressing member which is charged by the operation of the transfer corona discharger, as compared with the case where the pressing member is wholly made of, for example, a polyester resin. As a consequence, in the described embodiment, the surface potential of the pressing member 1 is maintained at levels lower than those obtained when the conventional pressing member having no sub-conductive member is used. Furthermore, the sub-conductive member 2 allows easier movement of the electrostatic charges, thus promoting distribution of the charges so as to contribute to the uniformalization of the surface potential.

The pressing member 1, which is made of, for example, a polyester resin film, tends to exhibit a large local concentration of charges due to friction with the dielectric sheet 14 or the bridge portion 4c connecting both axial ring portions 4a,4b of the transfer drum 4. The level and magnitude of fluctuation of surface potential due to such frictional charging can also be reduced by virtue of the sub-conductive member 2 on the pressing member 1.

The material of the conductive member, i.e., the sub-conductive member used in this embodiment, may be a magnetite-type ferrite ($FeO(Fe_2O_3)$ which exhibits a volumetric resistivity of $10^7$ Ω·cm to $10^{10}$ Ω·cm. In the described embodiment, the conductive member 2 is provided on the surface of the pressing member opposite to the surface facing the transfer means, for the following reasons.

As explained before, the corona discharge produces a strong oxidizing atmosphere which contains ozone and nitrogen oxides. A material having a spinel structure, e.g., a ferrite, changes its properties when placed in such a strong oxidizing atmosphere, due to changes of bivalent and trivalent ferrous into ferrous oxide ($Fe_2O_3$). More specifically, the volumetric resistivity of the ferrite is undesirably increased to a level exceeding $10^{11}$ Ω·cm. Thus, the volumetric resistivity of the conductive member 2 is increased to a level substantially approximating that of the pressing member 1, thus extinguishing the effect produced by the conductive member. Consequently, electrostatic charges are too heavily accumulated on the side of the pressing member 1 facing the transfer corona discharger 7, thus causing an impediment to the corona discharge. In order to avoid such an inconvenience, the conductive member 2 is provided on the side of the pressing member opposite to the transfer means including the transfer corona discharger.

The present invention is effective also in the case where the image transfer is conducted for a plurality of times with progressively increased transfer voltages.

Figure 11:
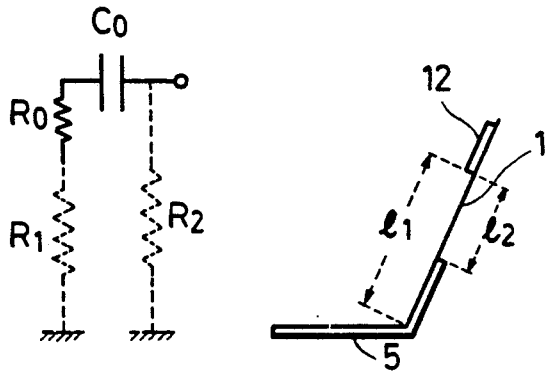
FIG. 11 is a schematic illustration of a critical portion of the first embodiment.

FIG. 11 is an electric circuit diagram of a charging-/discharging circuit formed by the pressing member, conductive member and the supporting member. A symbol $R_0$ represents the resistance value of the conductive member, i.e., the sub-conductive member, $R_1$ represents the resistance produced by the space of a distance $l_1$ between the supporting member 5 and the sub-conductive member 2 and $R_2$ represents the resistance formed by the space of a $l_2$ between the supporting member 5 and the sub-conductive member 2. The resistance values of the resistances $R_1$ and $R_2$ are about 100 to 200 MΩ and about 70 to 150 MΩ, respectively.

Almost no electric current was produced on the side of the pressing member composed of the resistance $R_0$ and $R_1$, and the surface potential of the side of the pressing member was substantially 0V. Meanwhile, the side of the pressing member containing the resistance $R_2$ showed a concentration of the charges locally to the region where the sub-conductive member 2 exists. The accumulation of the charges, however, is saturated at a certain level at which discharge is commenced to the supporting member 5 across the resistance $R_2$. Thus, the potential of the pressing member is maintained at a constant level, and is never increased beyond a certain level despite an increase in the transfer power. Thus, the increment of the transfer power is effectively used in the transfer of the image through discharge to the transfer member carrier sheet 14.

Although there is a slight fluctuation in the magnitude of the corona discharge, any influence of such a fluctuation is eliminated because the pressing member is chargeable to the above-described certain level so as to absorb such a fluctuation.

Thus, the present invention always produces a stable transfer electric field even when a high transfer voltages are repeatedly applied for superimposing toner images as in the case of a multi-color printing, whereby a multi-color image of an excellent quality is obtained without suffering from transfer irregularity.

In order to stably maintain the surface potential of the pressing member at a low level, it is preferred to use, as the material of the conductive member, a material having a volumetric resistivity smaller than that of the sub-conductive member 2 used in the illustrated embodiment. The use of a material having a volumetric resistivity not greater than $10^6$ Ω·cm, however, undesirably causes an instantaneous discharge of a large quantity of stored charges, so that the transfer electric filed is excessively strengthened at local minor points, with the results that local transfer defects in the form of rice grains are generated in the transferred image. This problem is serious particularly in the case where the transfer drum 4 is of the type having both end rings 4*a*, 4*b*, because the discharge takes place concentrically to these end rings r*a*, 4*b* from both end portions of the sub-conductive member 2. Consequently, the transfer defects appear concentrically at both ends of the image, particularly at the leading end of the image, seriously degrading the quality of the image.

Thus, according to the invention, the sub-conductive member 2 provided on the pressing member 1 has a volumetric resistivity ranging between $10^6$ Ω·cm and $10^{10}$ Ω·cm, preferably around $10^8$ Ω·cm, whereby a superior image quality is obtained by virtue of a uniform image transfer without suffering from transfer defect attributable to any local discharge.

As a result of a further study, the present inventors have found that the transfer apparatus of the present invention offers a greater effect when the toner as the developing agent for developing the image on the photosensitive drum 3 has a particle size not greater than 10 μm, more specifically around 8 μm in terms of mean particle size. A detailed description will be given in this connection with specific reference to FIG. 4.

Figure 4:
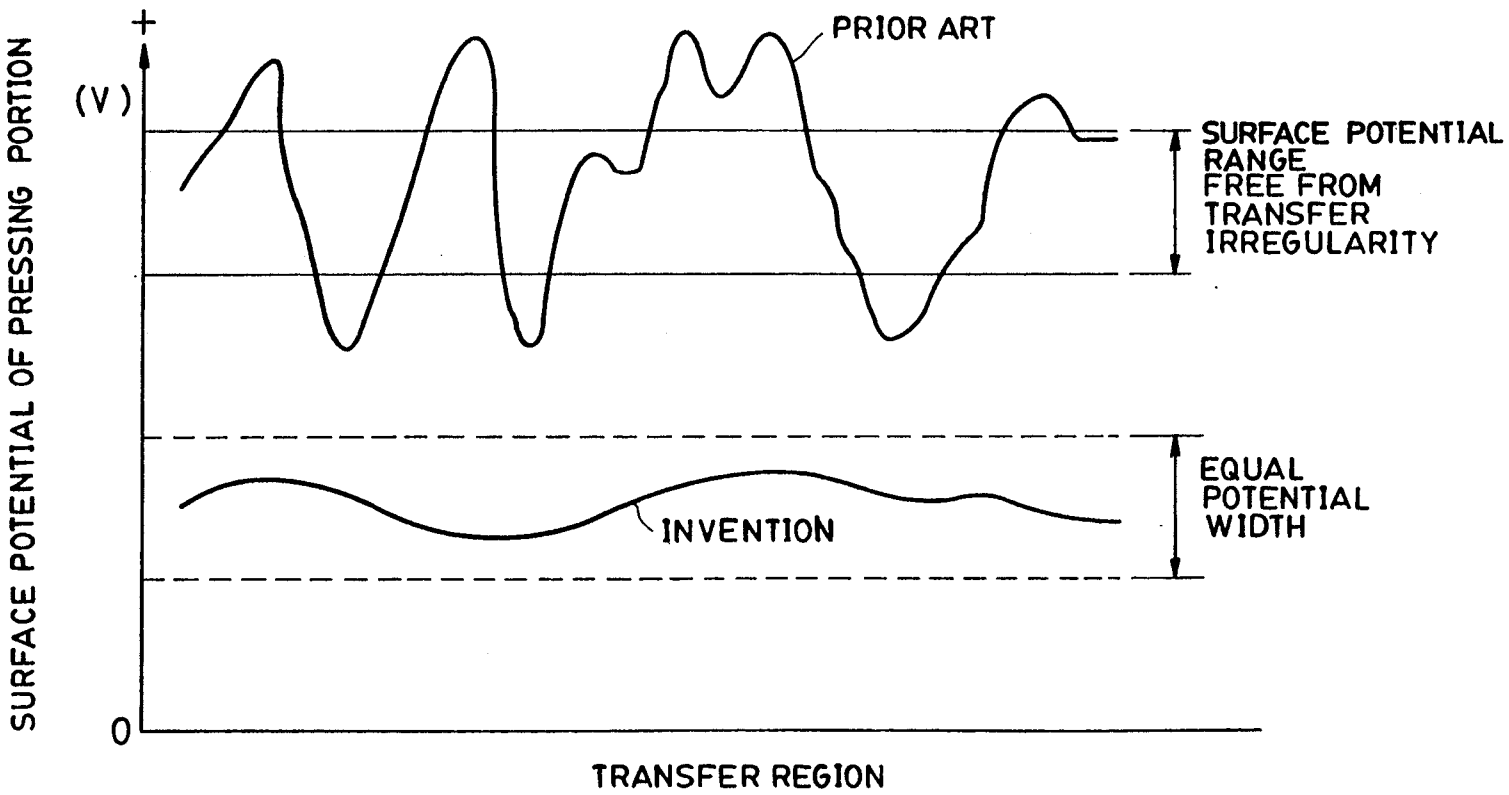
FIG. 4 is a chart showing the surface potential of a pressing portion as observed when a toner of a mean toner particle size of 8 μm is used.
Figure 5:
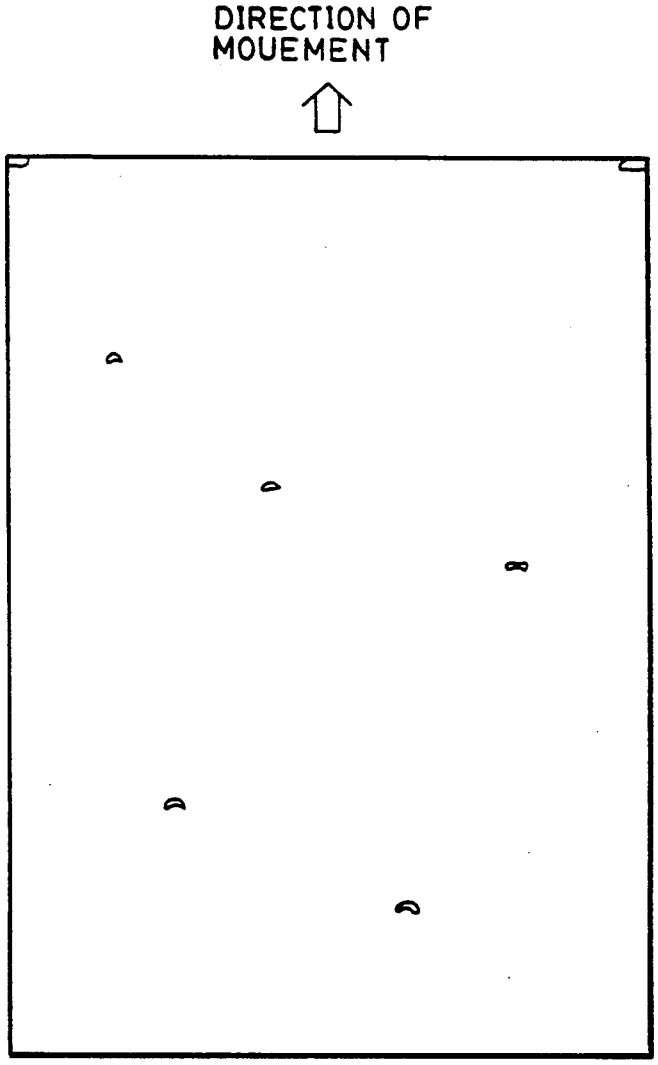
FIG. 5 is a schematic illustration showing a state of generation of local transfer defects.

As will be seen rom FIG. 4, images developed with toners of smaller particle sizes require stronger transfer electric fields than images developed with toners of greater particle sizes. Therefore, when an image developed with a finer toner is transferred with the aid of a conventional pressing member, the absolute value and the magnitude of fluctuation of the surface potential are greater than those observed when the image has been developed with a toner of a greater size, as will be understood from the comparison between FIG. 3 and FIG. 4.

As explained before, toners of smaller particle sizes generally exhibit greater levels of affinity or adhesion to the photosensitive drum and, hence, generally inferior transferability. Consequently, the surface potential range which is free from transfer irregularity is narrowed, as will be realized from a comparison between the width between two horizontal parallel solid lines shown in FIG. 4 representing the surface potential range free from the transfer irregularity and that shown in FIG. 3.

This problem, however, can be overcome by the present invention which employs the sub-conductive member 2 provided on the pressing member 18. As explained before, the sub-conductive member 2 effectively reduces both the level of the surface potential and the magnitude of the fluctuation of the surface potential. Two horizontal parallel broken lines in FIG. 4 shows the surface potential range free from the transfer irregularity equal to that shown by the two parallel horizontal solid lines in the same Figure. It will be seen that, when the image transfer is conducted with the aid of the pressing member having the sub-conductive member thereon, the surface potential is maintained within the above-mentioned range free from transfer irregularity, thus offering good state of image transfer even when a finer toner is used. It will be understood that the present invention allows the use of a finer toner for attaining a higher quality of the image, without being accompanied by any transfer irregularity.

Figure 9:
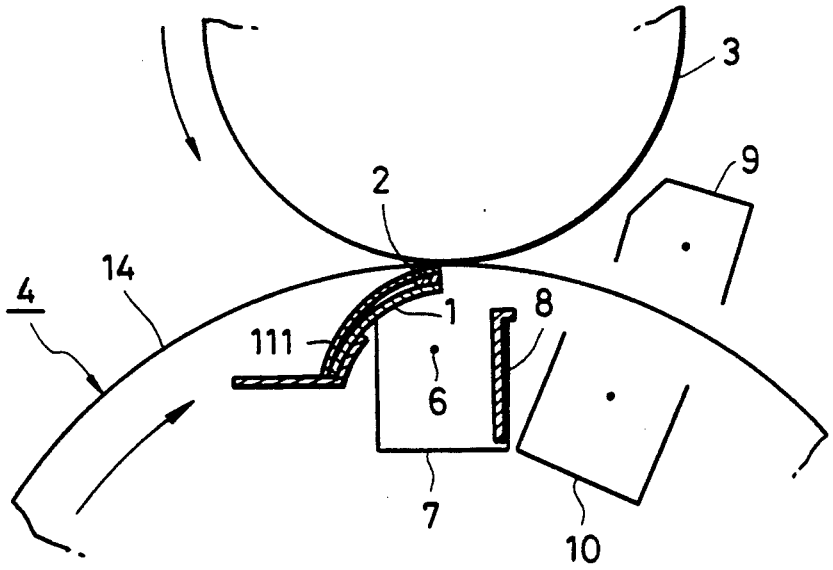
FIG. 9 is a schematic illustration of a pressing means used in a second embodiment of the present invention.

The inventors conducted a further study and experiment and found that wear of the sub-conductive member 2 is suppressed so that the sub-conductive member 2 can have an extended life when this layer 2 is covered with an additional layer 111 of pressing member serving as a protective member, as shown in FIG. 9 which illustrates a second embodiment of the present invention.

Preferably, the protective member 111 is made of a film of polyethylene terephthalate having a thickness greater than that of the pressing member 1, e.g., 75 μm, and is provided in such a manner as to cover the sub-conductive member 2.

It was confirmed that the provision of the protective member 111 does never impede the aforementioned advantages of the present invention. Moreover, better results were obtained by virtue of the protective member 111 since it allows the sub-conductive member 19 to be located on the end extremity of the pressing member without any risk of wear and damage.

Similar advantages were obtained also when the sub-conductive member 2 was grounded through the body of the apparatus.

Figure 10:
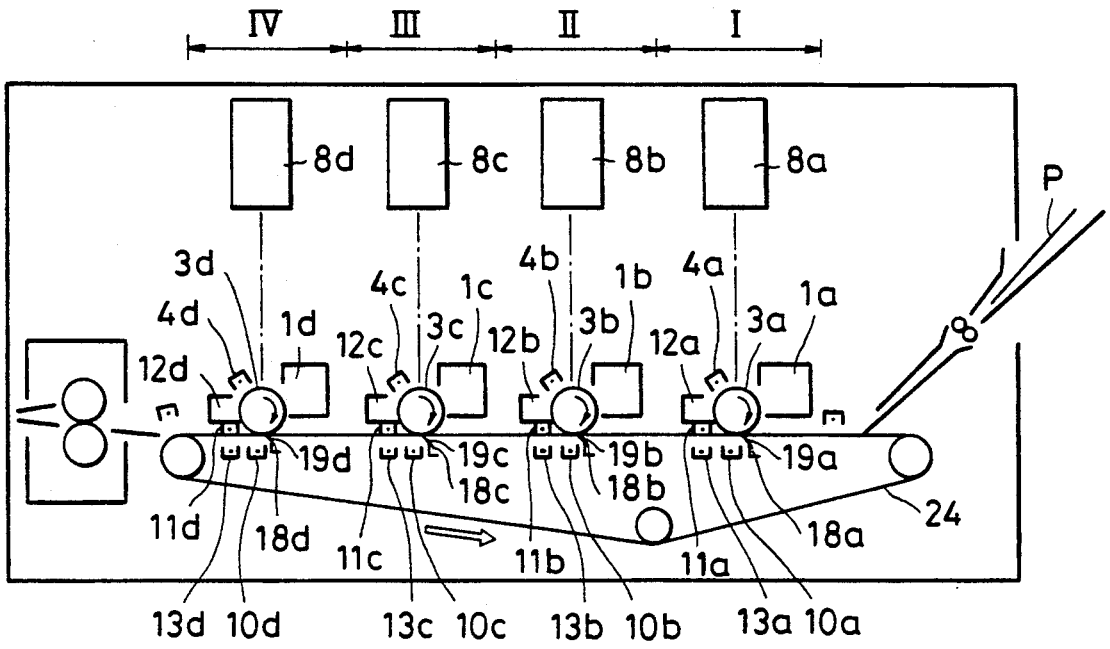
FIG. 10 is an illustration of another image forming apparatus for executing a color process.

The present invention can also be applied to a multicolor electrophotographic copying apparatus having four image forming units I to IV as shown in FIG. 10. The apparatus shown in FIG. 10, as a modification of the first embodiment of the present invention, has independent image forming units I to IV having photosensitive drums 3*a* to 3*d* and other components arranged around these drums 3*a* to 3*d*, including primary chargers 4*a* to 4*d*, exposure devices 8*a* to 8*d*, developing devices 1*a* to 1*d*, transfer chargers 10*a* to 10*d*, charge-removing dischargers 11*a* to 11*d* and 13*a* to 13*d*, and cleaners 12*a* to 12*d*. An endless conveyor 24 is disposed to extend through the image forming units I to IV at a position under the respective photosensitive drums.

The image forming units I to IV are provided with pressing members 18*a* to 18*d* which press the endless conveyor belt 20 towards the respective photosensitive drums within the discharge coverages of the associated transfer dischargers 10*a* to 10*d*. Sub-conductive members 19*a* to 19*d* are provided on the respective transfer dischargers 10*a* to 10*d*.

In this embodiment, the sub-conductive members, which are formed on the pressing members for pressing the endless conveyor belt towards the associated photosensitive drums, produce the same effect as that produced by the preceding embodiments, thus offering a better quality of the image.

Figure 12:
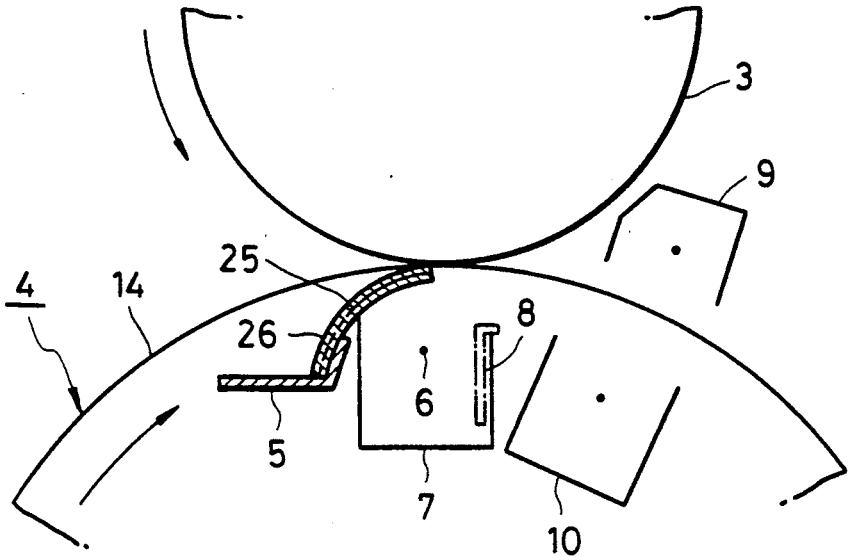
FIG. 12 is an illustration of a third embodiment of the present invention.
Figure 13:
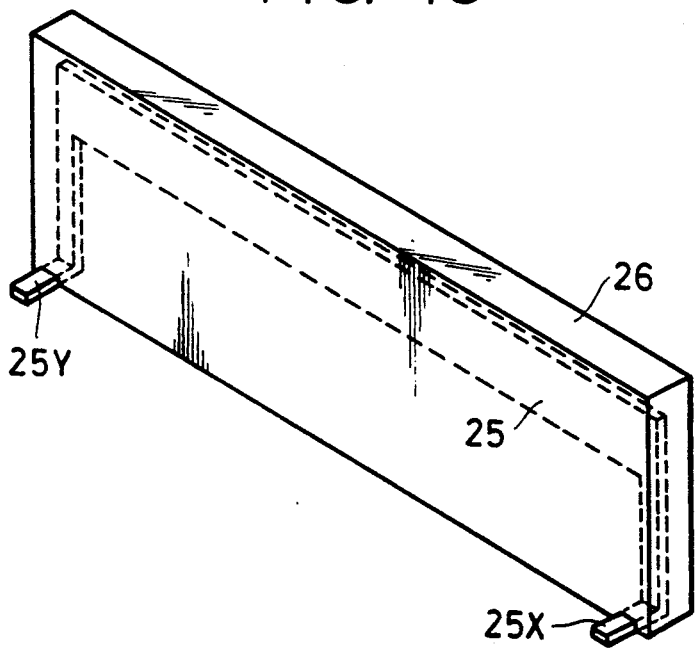
FIG. 13 is a perspective view of a pressing means used in the third embodiment.

FIGS. 12 and 13 show a third embodiment in which a conductive member 25 is provided inside the pressing member 26 which is an integral member having a volumetric resistivity of $10^{10}$ Ω·cm or grater. This embodiment produces substantially the same effects as those produced by the preceding embodiments. In order to apply a moderate pressing force to the dielectric sheet 14 while eliminating any substantial influence on the transfer electric field, the pressing member 26 preferably has a thickness ranging between 10 μm and 2 mm. Very good results were obtained when the thickness ranged between 75 and 200 μm. The conductive member 25 may have a volumetric resistivity of $10^5$ Ω·cm or less. Preferably, the conductive member 25 is formed from a metal foil having a thickness smaller than that of the pressing member 26.

In the illustrated embodiment, both longitudinal ends of the conductive member 25 are extended externally of the pressing member 26 so as to provide terminals 25X, 25Y for connection to grounded portions of the main part of the apparatus. These grounded portions are disposed such that the corona discharges for the image transfer do not directly act on these grounded portions.

Grounding of the conductive member 25, however, is not essential, and substantially the same effect could be obtained even when the conductive member 25 was held in a floating condition.

The first to third embodiments as described suffer from a common disadvantage in that a permanent strain of the pressing member is caused during a long use of the apparatus so that the pressing force is progressively decreased from the initial level, with the results that the quality of the image is degraded by presence of transfer irregularity and transfer defects after production of about 20,000 copies of A-4 size.

Figure 17:
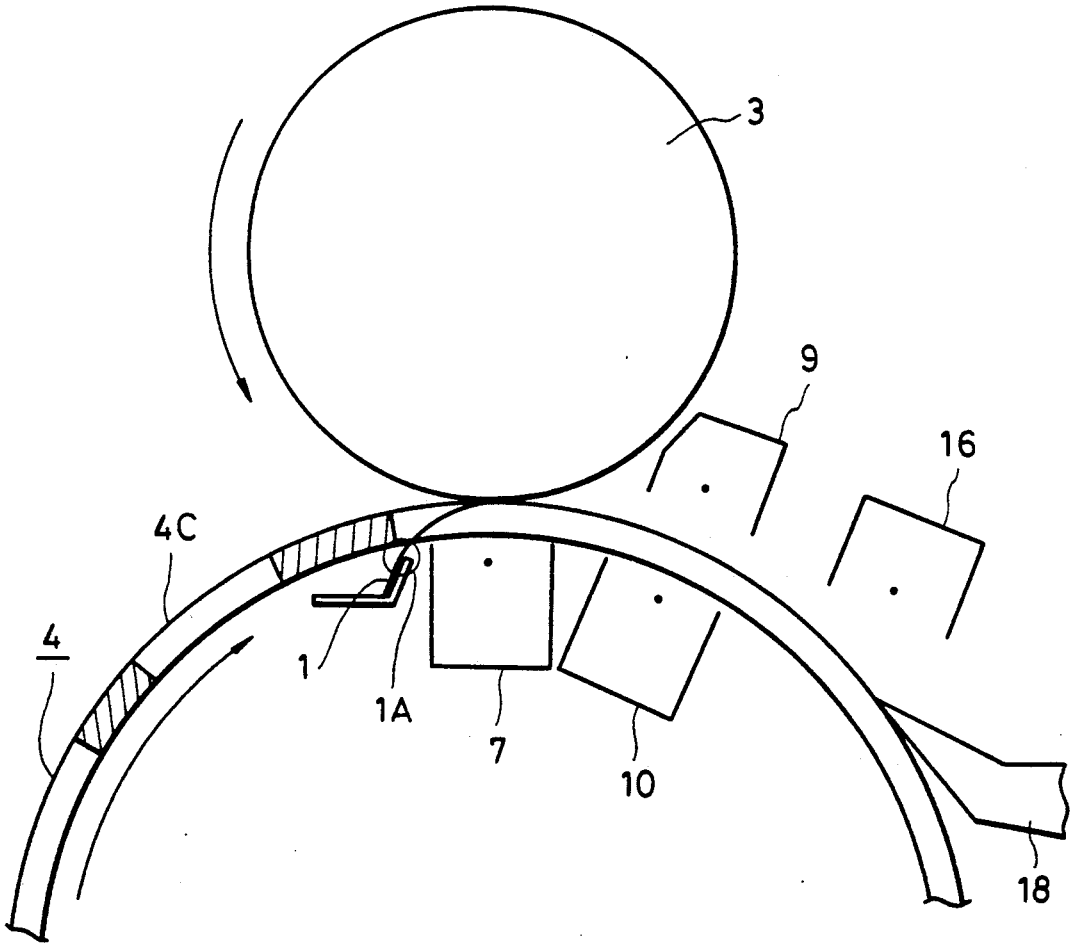
FIG. 17 is schematic illustration of the construction of a conventional image forming apparatus.
Figure 18:
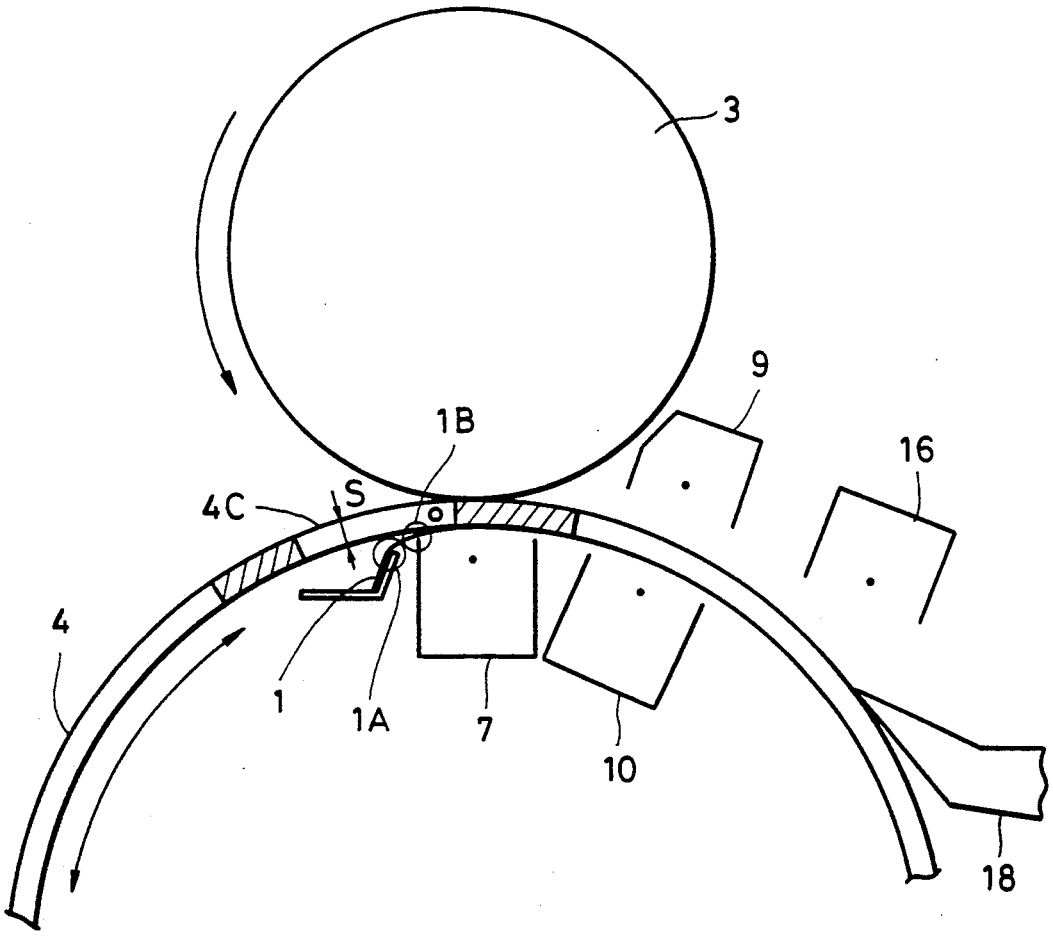
FIGS. 18 and 19 are illustrations of operation of the conventional image forming apparatus shown in FIG. 17.
Figure 19:
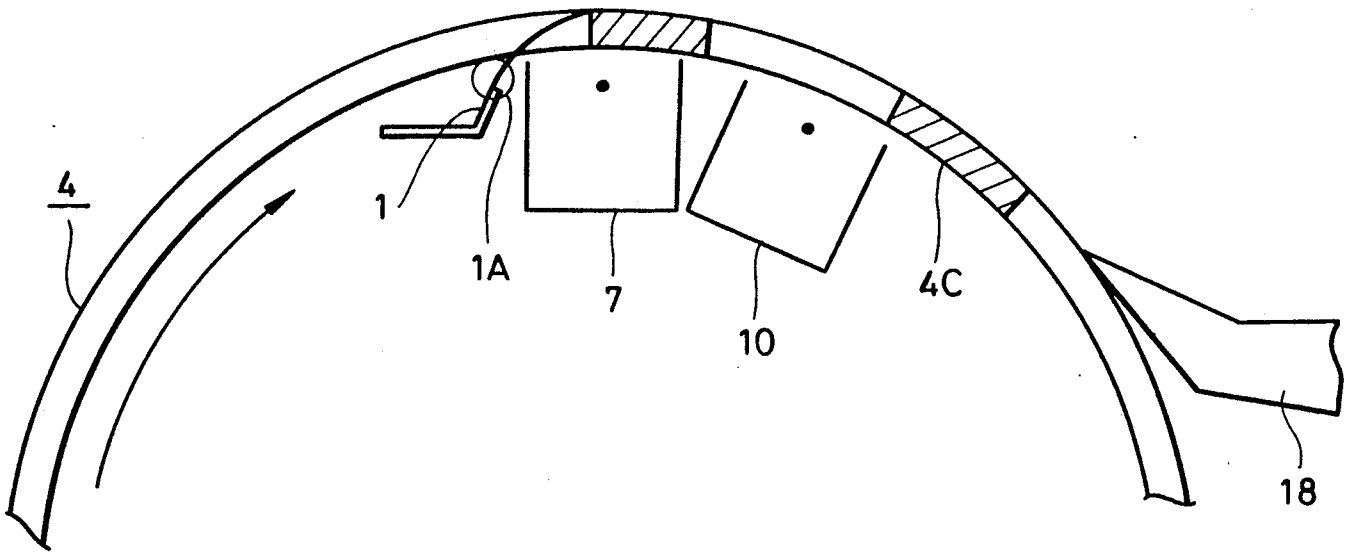

A description will be given of the mechanism of generation of such a permanent strain with reference to FIGS. 17 to 19 which are schematic sectional views of an essential portion of an electrophotographic copying apparatus showing particularly the positional relationship between the bridge portion 4*c* of the transfer drum 4. The transfer charger 7 and the pressing member 1. It will be understood that, when the pressing member 1 presses the dielectric sheet 14, a large force is applied to an end portion 1A of the pressing member 1 where the pressing member is fixed to the supporting member, as shown in FIG. 17. As the transfer drum 4 further rotates, the bridge portion 4*c* passes the transfer position where it contacts the pressing member 1 so as to further bend the pressing member 1 as shown in FIG. 18, whereby a greater force is applied to the above-mentioned end 1A of the pressing member and/or the portion 1B of the pressing member contacting the transfer charger 10. Thus, an excessively large force is locally applied to the pressing member 1 so as to generate a permanent strain in the pressing member 1.

Figure 14:
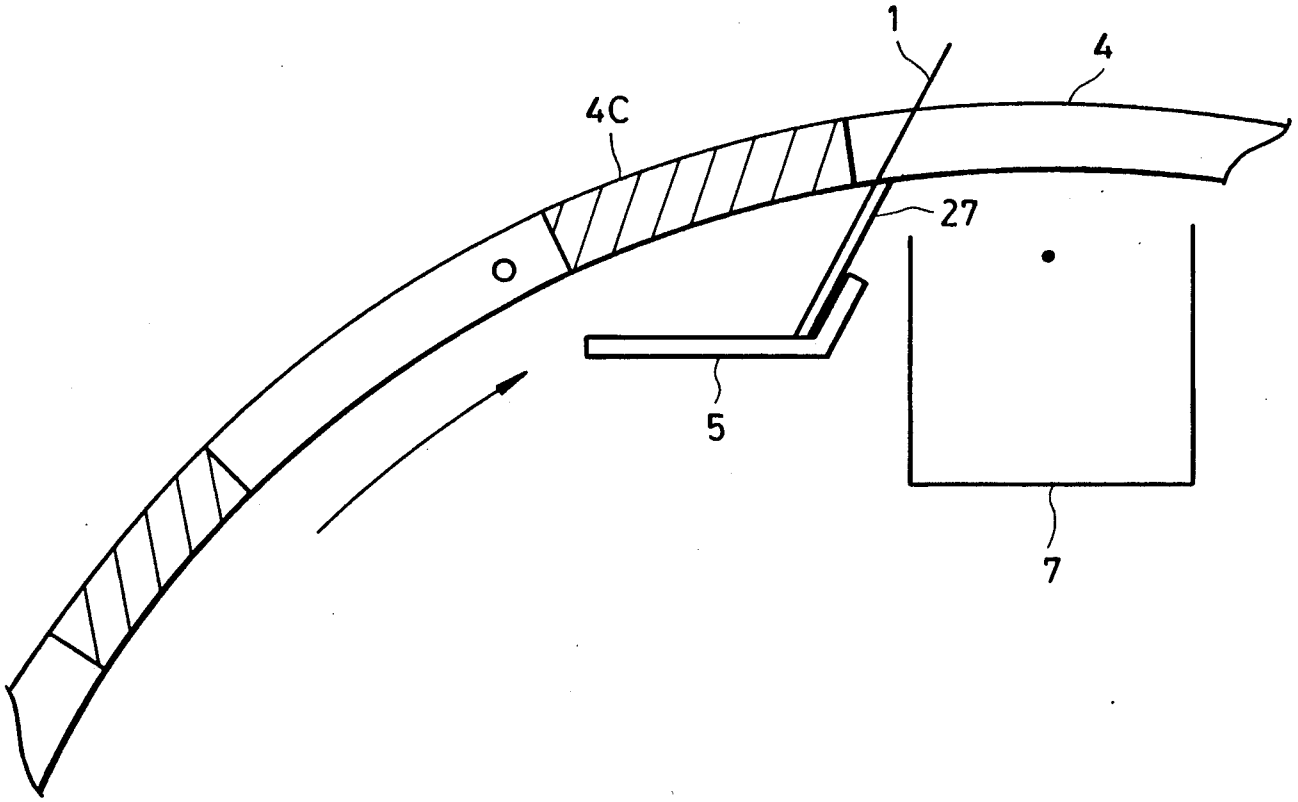
FIG. 14 is a schematic illustration of a fourth embodiment.

FIG. 14 shows a fourth embodiment of the present invention which overcomes the above-described problem. In this Figure, the dielectric sheet has been detached from the transfer drum 4 for the purpose of simplification of explanation. In this embodiment, a backup member 27 of a length smaller than the length of the pressing member 1 is attached to the side of the pressing member 1 adjacent the transfer charger 7.

In this embodiment, the pressing member 1 is made of a sheet of polyethylene terephthalate resin of 125 μm thick. The backup member 27 for urging the pressing member 1 into contact with the dielectric sheet 14 also is made of a sheet of polyethylene terephthalate resin of 100 μm thick. The backup member 27 is so arranged as not to contact the bridge portion 4*c* of the transfer drum 4.

A test operation was conducted to examine the relationship between the number of A-4 size copies and change in the level of the pressing force exerted by the pressing member in the copying apparatus of the embodiment shown in FIG. 14. A similar test was conducted also with the apparatus of the first embodiment, and the results were compared with each other.

Figure 15:
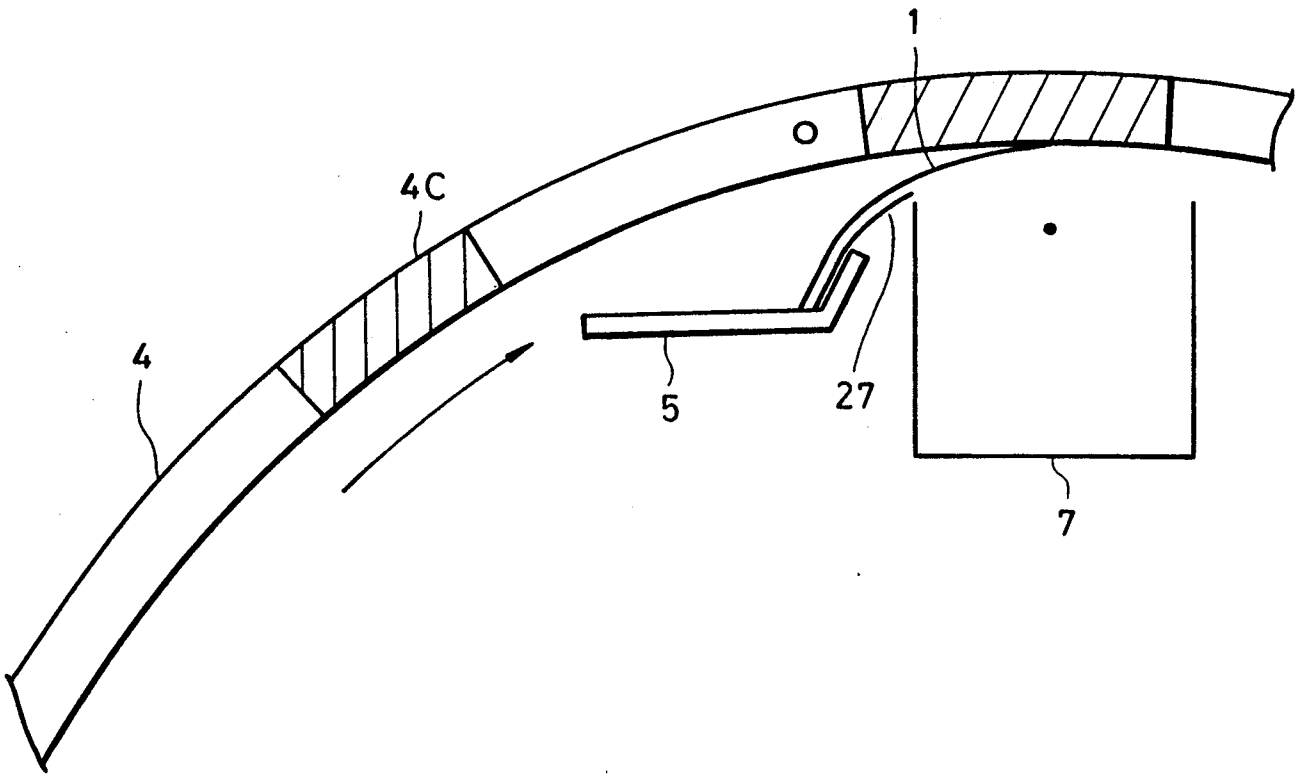
FIG. 15 is a schematic illustration of a fourth embodiment of the present invention.
Figure 16:
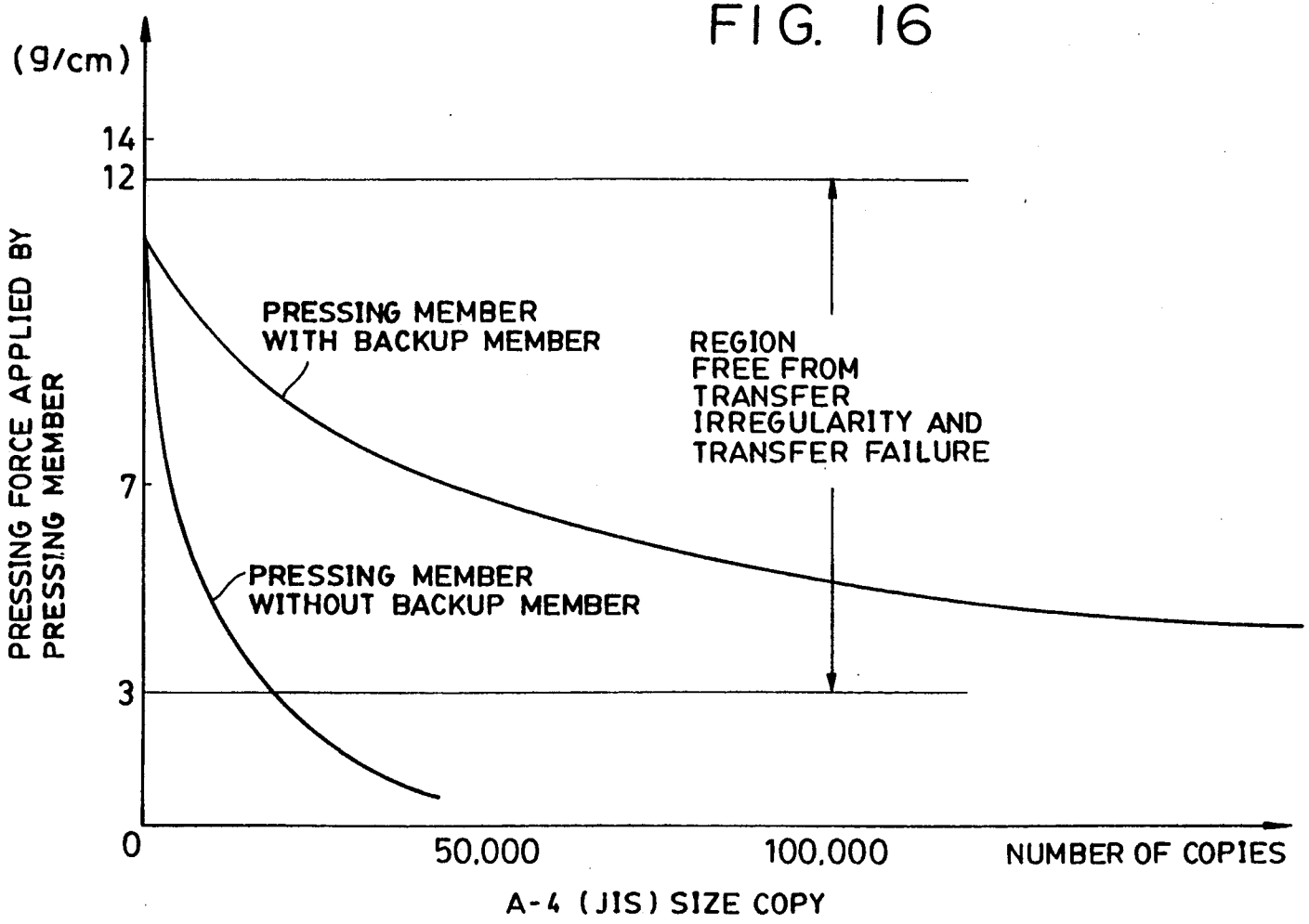
FIG. 16 is an illustration of the effect of a fourth embodiment.

Referring to FIG. 16, two horizontal parallel lines indicate upper and lower limits of the pressing force to be exerted by the pressing member for attaining good transfer of the image without transfer irregularity and transfer failure. When the pressing force is below the lower line indicating the lower limit of the pressing force, transfer defects are liable to occur due to a reduction in the transfer efficiency and transfer irregularity attributable to insufficient contact between the photosensitive drum and the transfer drum. Pressing force exceeding the level of the upper line indicative of the upper limit also tends to cause a degradation of the quality of the transferred image due to an irregular rotation of the transfer drum attributable to excessively large pressure of contact between the pressing member and the photosensitive drum. In the copying apparatus of the first embodiment having no backup member, the pressing force of the pressing member has come down below the lower limit of the adequate pressing force, after production of about 20,000 copies. In contrast, in the apparatus of the embodiment shown in FIG. 14, the pressing force was maintained within the range of the adequate pressing force even after production of 100,000 copies, by virtue of the backup member, as will be seen from FIG. 16. Thus, the embodiment shown in FIG. 14 offers a remarkable improvement in the durability of the pressing member. The reasons of this remarkable improvement will be described with reference to FIG. 15.

Referring to FIG. 15, the pressing member 1, which is backed up by the backup member 27, is in contact with the bridge portion 4c of the transfer drum 4. The backup member 27 serves to distribute the force applied to the pressing member, thus eliminating any local concentration of the bending stress to the fixed end portion of the pressing member 1 and the portion of the same contacting a shield plate of the transfer charger 7. Thus, the bending force is uniformly distributed over the region backed up by the backup member 27 so that generation of permanent strain is suppressed, whereby the life of the pressing member is extended. This enables the image forming apparatus to operate stably with good quality of the transferred image for a longer time.

The embodiment shown in FIG. 14 employs two sheets, i.e., the pressing member and the backup member. This, however, is not exclusive and three of more such sheets may be employed. In such a case, the above-described advantage can be brought about provided that at least one of these sheets has a free length greater than those of other sheets. The effect will be enhanced if these sheets are arranged such that at least one of these sheets kept out of contact with the bridge portion of the transfer drum.

The embodiment shown in FIG. 14 can be combined with any of the preceding embodiments. Such a combination will enable the pressing member to maintain the adequate pressing force for a longer period, thus offering a great advantage in that the image forming apparatus can operate for longer time without suffering substantial degradation of the image quality.

What is claimed is:

1. An image forming apparatus comprising:

image carrying means;

toner image forming means [illegible]rming a toner image on said image carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including a pressing member and a conductive member provided on the side of said pressing member facing said transfer member carrying mean which is pressed by said pressing member.

2. An image forming apparatus according to claim 1, wherein said conductive member is fixed to said pressing member.

3. An image forming apparatus according to claim 1, wherein said image transfer means superimposes a plurality of toner images on the same transfer member.

4. An image apparatus according to claim 3, wherein said image transfer means applies a transfer voltage the level of which is raised in a stepped manner corresponding to superimposition of said plurality of toner images.

5. An image forming apparatus according to claim 3, wherein said toner images are of different colors.

6. An image forming apparatus according to claim 1, wherein said image transfer means includes a corona discharger.

7. An image forming apparatus according to claim 6, wherein said corona discharger includes a corona discharge electrode, shield electrodes surrounding said corona discharge electrode, and an insulating member provided on the surface of one of said shield electrodes facing said corona discharge electrode.

8. An image forming apparatus according to claim 7, wherein said insulating member is provided on a shield electrode which is on the downstream portion of said corona discharger as viewed in the direction of rotation of said transfer member conveying means.

9. An image forming apparatus according to claims 1 and 8 wherein said pressing means is disposed upstream of said image transfer means as viewed in the direction of rotation of said transfer member conveying means.

10. An image forming apparatus according to claim 6 wherein said pressing member is made of a dielectric material and is disposed within a zone of discharge performed by said corona discharger.

11. An image forming apparatus according to claim 6, wherein said conductive member is disposed at a position where it is influenced by the corona discharge performed by said corona discharger.

12. An image forming apparatus according to claim 1, wherein said transfer member carrying means includes a dielectric sheet.

13. An image forming apparatus according to claims 1 or 2 wherein said pressing member is made of a dielectric material.

14. An image forming apparatus according to claim 13, wherein said conductive member and said pressing member are sheet-like members.

15. An image forming apparatus according to claim 13, wherein said pressing member has a volumetric resistivity not smaller than $10^{10}$ Ω·cm.

16. An image forming apparatus according to claim 1, wherein said pressing means further includes a supporting member for supporting said pressing member.

17. An image forming apparatus according to claim 1, wherein said conductive member is disposed near the end of said pressing member adjacent said image carrying means.

18. An image forming apparatus according to claim 1, wherein said conductive member has a volumetric resistivity ranging between $10^6$ Ω·cm and $10^{10}$ Ω·m.

19. An image forming apparatus according to claim 1, wherein said pressing means further includes a backup member provided on the side of said pressing member opposite to said transfer member carrying means and backing up said pressing member.

20. An image forming apparatus according to claim 19, wherein said backup member has a length smaller than that of said pressing member towards said image carrying means.

21. An image forming apparatus according to claim 19, wherein said backup member is a sheet-like member.

22. An image forming apparatus according to claim 19, wherein said backup member is made of a dielectric material.

23. An image forming apparatus according to claim 19, wherein said transfer member conveying means includes a pair of parallel ring-shaped members and a bridge member interconnecting said ring-shaped members.

24. An image forming apparatus according to claim 23, wherein said backup member is disposed so as not to contact said bridge member.

25. An image forming apparatus according to claim 1, wherein said pressing member and said conductive member are disposed to extend in the longitudinal direction of said transfer member conveying means.

26. An image forming apparatus according to claim 25, wherein said conductive member is disposed to extend in the longitudinal direction of said transfer member conveying means over the entire region of image transfer performed by said image transfer means.

27. An image forming apparatus according to claim 1, wherein said toner has a mean particle size not greater than 10 μm.

28. An image forming apparatus according to claim 1, wherein said conductive member is electrically insulated.

29. An image forming apparatus according to claim 1, wherein said transfer member conveying means includes a pair of parallel ring-shaped members and a bridge member interconnecting said ring-shaped members.

30. An image forming apparatus according to claim 23 or 29, wherein said transfer member carrying means is provided to cover an annular region defined by said ring-shaped members and said bridge member.

31. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including first and second pressing members and a conductive member provided between said first and second pressing members, wherein each of said first and second pressing members is made of a dielectric material.

32. An image forming apparatus according to claim 31, wherein said conductive member is clamped by said first and second pressing members.

33. An image forming apparatus according to claim 31, wherein said image transfer means superposes a plurality of toner images on the same transfer member.

34. An image forming apparatus according to claim 33, wherein said toner images are of different colors.

35. An image forming apparatus according to claim 31, wherein said image transfer means includes a corona discharger.

36. An image forming apparatus according to claim 35, wherein said corona discharger includes a corona discharge electrode, shield electrodes surrounding said corona discharge electrode, and an insulating member provided on the surface of one of said shield electrodes facing said corona discharge electrode.

37. An image forming apparatus according to claim 36, wherein said insulating member is provided on a shield electrode which is on the downstream portion of said corona discharger as viewed in the direction of rotation of said transfer member conveying means.

38. An image forming apparatus according to claims 31 or 37, wherein said pressing means is disposed upstream of said image transfer means as viewed in the direction of rotation of said transfer member conveying means.

39. An image forming apparatus according to claim 35, wherein said first and second pressing members are disposed within a zone of discharge performed by said corona discharger.

40. An image forming apparatus according to claim 35, wherein said conductive member is disposed at a position where it is influenced by the corona discharge performed by said corona discharger.

41. An image forming apparatus according to claim 31, wherein said transfer member carrying means includes a dielectric sheet.

42. An image forming apparatus according to claim 31, wherein said conductive member and said first and second pressing members are sheet-like members.

43. An image forming apparatus according to claims 31 or 42, wherein said conductive member is disposed between said first and second pressing members near the ends of said pressing members adjacent said image carrying means.

44. An image forming apparatus according to claim 31, wherein each of said first and second pressing members has a volumetric resistivity not smaller than $10^{10}$ Ω·cm.

45. An image forming apparatus according to claims 31 or 44, wherein said conductive member has a volumetric resistivity ranging between $10^6$ Ω·cm and $10^{10}$ Ω·cm.

46. An image forming apparatus according to claim 31, wherein said pressing means further includes a supporting member for supporting said first and second pressing members.

47. An image forming apparatus according to claim 31, wherein said pressing means further includes a backup member provided on the side of said first and second pressing members opposite to said transfer member carrying means and backing up said first and second pressing members.

48. An image forming apparatus according to claim 47, wherein said backup member has a length smaller than those of said first and second pressing members towards said image carrying means.

49. An image forming apparatus according to claim 47, wherein said backup member is a sheet-like member.

50. An image forming apparatus according to claim 47, wherein said backup member is made of a dielectric material.

51. An image forming apparatus according to claim 47, wherein said transfer member conveying means includes a pair of parallel ring-shaped members and a bridge member interconnecting said ring-shaped members.

52. An image forming apparatus according to claim 51, wherein said backup member is disposed so as not to contact said bridge member.

53. An image forming apparatus according to claim 31, wherein said first and second pressing members and said conductive member are disposed to extend in the longitudinal direction of said transfer member conveying means.

54. An image forming apparatus according to claim 53, wherein said conductive member is disposed to extend in the longitudinal direction of said transfer member conveying means over the entire region of image transfer performed by said image transfer means.

55. An image forming apparatus according to claim 31, wherein said toner has a mean particle size not greater than 10 μm.

56. An image forming apparatus according to claim 31, wherein said conductive member is electrically insulated.

57. An image forming apparatus according to claim 31, wherein said transfer member conveying means includes a pair of parallel ring-shaped members and a bridge member interconnecting said ring-shaped members.

58. An image forming apparatus according to claims 51 or 57, wherein said transfer member carrying means is provided to cover an annular region defined by said ring-shaped members and said bridge member.

59. An image forming apparatus according to claim 31, wherein one of said first and second pressing members closer to said image transfer means has a thickness greater than the other pressing member which is disposed closer to said transfer member carrying means.

60. An image forming apparatus according to claim 31, wherein said first and second pressing members are formed integrally with each other.

61. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including a pressing member and a backup member disposed on the side of said pressing member adjacent said image transfer means and backing up said pressing member, wherein said back-up member has a length smaller than that of said pressing member towards said image carrying means.

62. An image forming apparatus according to claim 61, wherein said image transfer means superposes a plurality of toner images on the same transfer member.

63. An image, forming apparatus according to one of claims 61 and 62, wherein said toner images are of different colors.

64. An image forming apparatus according to claim 61, wherein said image transfer means includes a corona discharger.

65. An image forming apparatus according to claim 64, wherein said pressing member is made of a dielectric material and is disposed within a zone of discharge performed by said corona discharger.

66. An image forming apparatus according to claim 61, wherein said transfer member carrying means includes a dielectric sheet.

67. An image forming apparatus according to claim 61, wherein each of said pressing member and said backup member is made of a dielectric material.

68. An image forming apparatus according to claim 67, wherein each of said pressing member and said backup member is a sheet-like member.

69. An image forming apparatus according to claim 67, wherein each of said pressing member and said backup member has a volumetric resistivity not smaller than $10^{10}$ Ω·cm.

70. An image forming apparatus according to claim 61, wherein said pressing means is disposed upstream of said image transfer means as viewed in the direction of rotation of said transfer member conveying means.

71. An image forming apparatus according to claim 61, wherein said toner has a mean particle size not greater than 10 μm.

72. An image forming apparatus according to claim 61, wherein said transfer member conveying means includes a pair of parallel ring-shaped members and a bridge member interconnecting said ring-shaped members.

73. An image forming apparatus according to claim 72, wherein said transfer member carrying means is provided to cover an annular region defined by said ring-shaped members and said bridge member.

74. An image forming apparatus according to claim 72, wherein said backup member is disposed so as not to contact said bridge member.

75. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including first and second pressing members and a conductive member provided between said first and second pressing members, wherein said conductive member has a volumetric resistivity ranging between $10^6$ Ω·cm and $10^{10}$ Ω·cm.

76. An image forming apparatus according to claim 75, wherein said image transfer means includes a corona discharger.

77. An image forming apparatus according to claim 76, wherein said conductive member is disposed at a position where it is influenced by the corona discharge performed by said corona discharger.

78. An image forming apparatus according to claim 75, wherein said conductive member and said first and second pressing members are sheet-like members.

79. An image forming apparatus according to claim 75, wherein said conductive member is disposed between said first and second pressing members near the ends of said pressing members adjacent said image carrying means.

80. An image forming apparatus according to claim 75, wherein said first and second pressing members and said conductive member are disposed to extend in the longitudinal direction of said transfer member conveying means.

81. An image forming apparatus according to claim 80, wherein said conductive member is disposed to extend in the longitudinal direction of said transfer member conveying means over the entire region of image transfer performed by said image transfer means.

82. An image forming apparatus according to claim 75, wherein said conductive member is electrically insulated.

83. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including first and second pressing members and a conductive member provided between said first and second pressing members, wherein said pressing means is disposed upstream of said image transfer means as viewed in the direction of rotation of said transfer member conveying means.

84. An image forming apparatus according to claim 83, wherein said image transfer means includes a corona discharger.

85. An image forming apparatus according to claim 84, wherein said first and second pressing members are disposed within a zone of discharge performed by said corona discharger.

86. An image forming apparatus according to claim 85, wherein said conductive member and said first and second pressing members are sheet-like members.

87. An image forming apparatus according to claim 84, wherein said conductive member is disposed at a position where it is influenced by the corona discharge performed by said corona discharger.

88. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including first and second pressing members and a conductive member provided between said first and second pressing members, wherein said first and second pressing members and said conductive member are disposed to extend in the longitudinal direction of said transfer member conveying means.

89. An image forming apparatus according to claim 88, wherein said conductive member is disposed to extend in the longitudinal direction of said transfer member conveying means over the entire region of image transfer performed by said image transfer means.

90. An image forming apparatus comprising:

image carrying means;

toner image forming means for forming a toner image on said carrying means;

transfer member conveying means for conveying a transfer member to an image transfer position and including transfer member carrying means for carrying said transfer member;

image transfer means for causing said toner image to be transferred to said transfer member carried by said transfer member carrying means at said image transfer position; and pressing means disposed in the vicinity of said image transfer means and capable of pressing said transfer member carrying means towards said image carrying means, said pressing means including a pressing member and backup member disposed on the side of said pressing member adjacent said image transfer means and backing up said pressing member, wherein each of said pressing member and said backup member is made of a dielectric material.

91. An image forming apparatus according to claim 90, wherein said image transfer means includes a corona discharger.

92. An image forming apparatus according to claim 91, wherein said pressing member is made of a dielectric material and is disposed within a zone of discharge performed by said corona discharger.

93. An image forming apparatus according to claim 91, wherein each of said pressing member and said backup member is made of a dielectric material.

94. An image forming apparatus according to claim 90, wherein each of said pressing member and said backup member has a volumetric resistivity not smaller than $10^{10}$ Ω·cm.

95. An image forming apparatus comprising:

image carrying means;

toner image forming means for forming a toner image on said image carrying means;

transfer member conveying means for conveying a transfer member and including transfer member carrying means for carrying said transfer member to transfer said toner image to said transfer member;

corona discharger disposed on the opposite side of said image carrying means with respect to said transfer member conveying means; and pressing means disposed in the vicinity of said corona discharger and capable of pressing said transfer member carrying means, said pressing means comprises a pressing member and a conductive member disposed on the nearer side to said transfer member carrying means than said pressing member.

96. An image forming apparatus according to claim 95, wherein said pressing means further comprises a second pressing member disposed on the nearer side to said transfer member carrying means than said conductive member.

97. An image forming apparatus according to claims 95 or 96, wherein said image transfer means superposes a plurality of toner images on the same transfer member.

98. An image forming apparatus according to claim 96, wherein said pressing member and said second pressing member are made of a dielectric material.

99. An image forming apparatus according to claim 98, wherein said pressing member and said second pressing member has a volumetric resistivity not smaller than $10^{10}$ Ω·cm.

100. An image forming apparatus according to claim 96, wherein said pressing member, said second pressing member and said conductive member are disposed to extend in the longitudinal direction of said transfer member conveying means.

101. An image forming apparatus according to claims 95 or 96, wherein said conductive member is electrically insulated.

102. An image forming apparatus according to claim 97, wherein said toner images are of different colors.

103. An image forming apparatus according to claim 95, wherein said pressing member is made of a dielectric material.

104. An image forming apparatus according to claims 95 or 103, wherein said conducive member and said pressing member are sheet-like members.

105. An image forming apparatus according to claim 103, wherein said pressing member has a volumetric resistivity not smaller than $10^{10}$ Ω·cm.

106. An image forming apparatus according to claims 95 or 105, wherein said conductive member has a volumetric resistivity ranging between $10^6$ and $10^{10}$ Ω·cm.

107. An image forming apparatus according to claims 95 or 105, wherein said conductive member is disposed at a position where it is influenced by the corona discharge performed by said corona discharger.

108. An image forming apparatus according to claim 95, wherein said pressing member is made of a dielectric material and is disposed within a zone of discharge performed by said corona discharger.

109. An image forming apparatus according to claim 95, wherein said pressing member and said conductive member are disposed to extend in the longitudinal direction of said transfer member conveying means.

110. An image forming apparatus according to claims 1, 31, 75, 83, 88, or 95, wherein said conductive member is grounded.

* * * * *